US006152768A

United States Patent [19]

Beugnot et al.

[11] Patent Number: 6,152,768

[45] Date of Patent: Nov. 28, 2000

[54] LOCKING ELECTRICAL CONNECTOR HOUSING MEMBER

[75] Inventors: Philippe Beugnot, Montigny le Bretonneux; Sylvain Cloarec, Viroflay; Jean-Louis Duclos, Elancourt, all of France

[73] Assignee: Connecteurs Cinch, Montigny-le-Bretonneux, France

[21] Appl. No.: 09/243,513

[22] Filed: Feb. 1, 1999

[30] Foreign Application Priority Data

Feb. 11, 1998 [FR] France ..... 98.01629

[51] Int. Cl.[7] ..... H01R 13/40

[52] U.S. Cl. ..... 439/595; 439/744

[58] Field of Search ..... 439/595, 744, 439/752, 141, 143, 144

[56] References Cited

U.S. PATENT DOCUMENTS 5,069,639 12/1991 Kodama et al. ..... 439/595
5,522,740 6/1996 Plocek et al. ..... 439/595
5,674,088 10/1997 Roche et al. ..... 439/595

FOREIGN PATENT DOCUMENTS 691 708 A1 1/1996 European Pat. Off. .
716 475 A2 6/1996 European Pat. Off. .

*Primary Examiner*—Khiem Nguyen
*Assistant Examiner*—Hae Moon Hyeon
*Attorney, Agent, or Firm*—Pearne & Gordon LLP

[57] ABSTRACT

An electrical connector housing element has a locking key inserted in a passage parallel to and between channels in the housing element. The housing element has elastic tongues projecting into the conduit and the locking key terminates in a protuberance which, in a locking position, pushes the tongues through corresponding slots into the channels so that they project into the channels at the rear end of the electrical contact members.

4 Claims, 2 Drawing Sheets

LOCKING ELECTRICAL CONNECTOR HOUSING MEMBER

BACKGROUND OF THE INVENTION

1. Field of the Invention

The present invention concerns an electrical connector housing member.

The invention concerns electrical connectors comprising a first housing member having a series of channels each adopted to receive an electrical contact member and a housing member complementary to the first housing member with a series of channels each adapted to receive an electrical contact member complementary to those of said first housing member.

2. Description of the Prior Art

To retain the electrical contact members in the channels, elastic locking lugs are generally provided with a projecting lug in the channels adapted to cooperate with a corresponding opening in the electrical contact member so that when the contact member is being inserted the lug retracts elastically and when the contact member is in position the lug is inserted in the opening to immobilize the member.

As the electrical contact members and the housings are often very small, if traction is applied to the conductors to which said members are fixed, the locking lugs are bent and said members can be detached unintentionally.

To overcome this drawback it has been proposed to provide a passage between two adjacent channels and to insert in it an immobilizing member which, cooperating with the outside face of the locking lugs, prevents them bending.

If the connectors are in locations subject to significant temperature differences or vibration there is provided in addition to the above locking system a complementary locking key in the form of a strip or a comb that engages in the housing element perpendicularly to the axes of the channels and which abuts against the rear end of the electrical contact members.

An arrangement of the above kind is totally effective but it has the drawback of being relatively complex, in particular with regard to the fabrication of the housing element. Also, it can be used only when the housing elements are parallelepiped-shape and the channels are parallel and in parallel planes.

An aim of the invention is to provide an electrical connector housing element that combines the advantages of an immobilizing member and of a locking key and which remedies the drawbacks of the prior art connector housing element.

SUMMARY OF THE INVENTION

The invention consists in an electrical connector housing element comprising an insulative material body having at least two parallel channels each adapted to receive an electrical contact member with a front end adapted to cooperate with a complementary electrical contact member of a complementary housing element and a rear end adapted to be fixed to an end of an electrical conductor, elastic locking lugs cut out from said channels and having studs projecting into said channels and adapted to cooperate with openings of said electrical contact members when they are in place in said channels, and a locking key inserted in a passage parallel to and between said channels, said key being adapted to occupy a pre-locking position to enable insertion of said electrical contact members in said channels so that said locking lugs can retract elastically for positioning said electrical contact members and a locking position in which it cooperates with a face of said locking lugs opposite that provided with said studs, wherein said housing element has elastic tongues projecting into said passage and said locking key terminates in a protuberance adapted, in said locking position, to push said tongues through corresponding slots in said channels so that they project into said channels at a rear end of said electrical contact members.

Because of this arrangement, and in a single operation, the electrical contact members are immobilized both towards the front and towards the rear. Also, connectors can be made with any shape, for example cylindrical.

In accordance with one feature of the invention, said elastic tongues have projections near their free end and facing towards said passage and said protuberance on said locking key is a pointed portion having two inclined planes adapted to cooperate with said projections.

In accordance with another feature of the invention, said locking key has two walls with free ends having ramps adapted to cooperate with studs provided on said projections on said tongues.

Accordingly, when the key is withdrawn from its locking position to its pre-locking position, the ramps cooperate with the studs which tend to return the tongues to their initial position. The material of the housing element can lose some of its elastic properties with time; in this case, when the locking key is withdrawn, the tongues could wedge the rear end of the electrical contact members.

Finally, in accordance with a last feature of the invention, the inclined planes of the key are extended by flats.

The invention will now be described in more detail with reference to one particular embodiment shown by way of example only in the accompanying drawings.

DETAILED DESCRIPTION OF THE PREFERRED EMBODIMENT

The various figures show a housing element 1 of an electrical connector adapted to cooperate with a complementary element 2 shown schematically in chain-dotted outline.

The element 1 comprises two channels 3 each adapted to receive a female electrical contact member 4.

Figure 5:
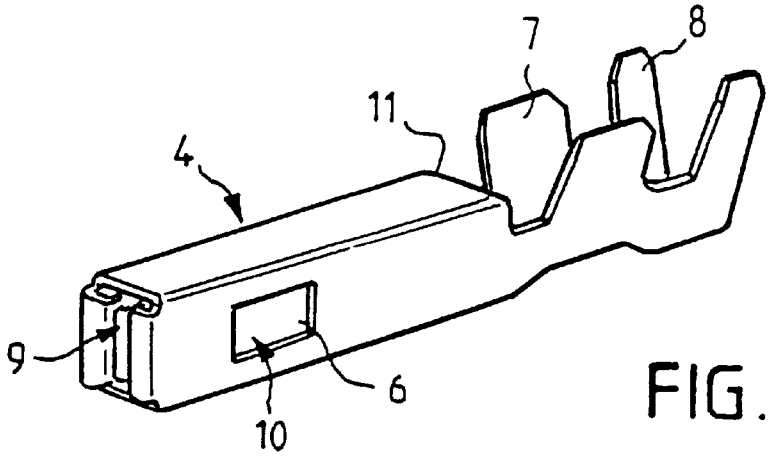
FIG. 5 is a perspective view of a female member accommodated in the housing element.

FIG. 5 shows one such electrical contact member which has a body 6 with lugs 7 and 8 at one end for fixing it to an electrical conductor and an elastic clamp 9 at the other end adapted to grip a flat male member.

The body 6 has openings 10 in its side walls and cut-outs that form a shoulder 11 at the end adjacent the lugs 7.

In the embodiments shown, the electrical contact members 4 are female members but they could equally well be male members, in which case the elastic clamp 9 would be replaced by a flat tongue.

Each channel 3 has an insertion end 3*a* enabling insertion of a member 4 and an abutment 3*b* against which the member 4 bears when in place. The end adjacent the abutment 3*b* has openings 5 in it through which corresponding male members inserted into the housing element 1 pass.

Between the channels 3 is a passage 12 with two cut-out locking lugs 15 each of which has an immobilizing stud 16 with an inclined ramp 16*a* terminating in an upright face 16*b*.

The inclined ramps 16*a* are on the side facing towards the end 3*a* and the upright face is on the side facing towards the abutment 3*b*.

Figure 2:
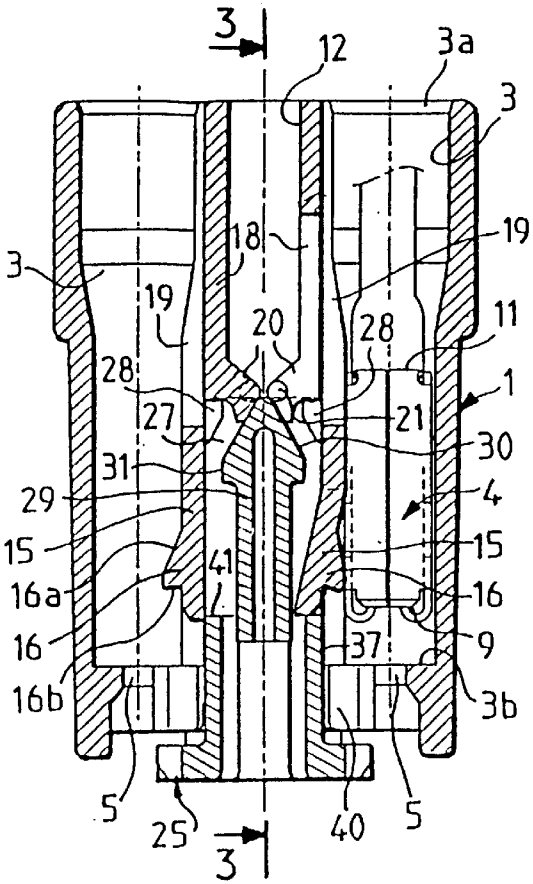
FIG. 2 is a view in section taken along the line 2—2 in FIG. 1.
Figure 4:
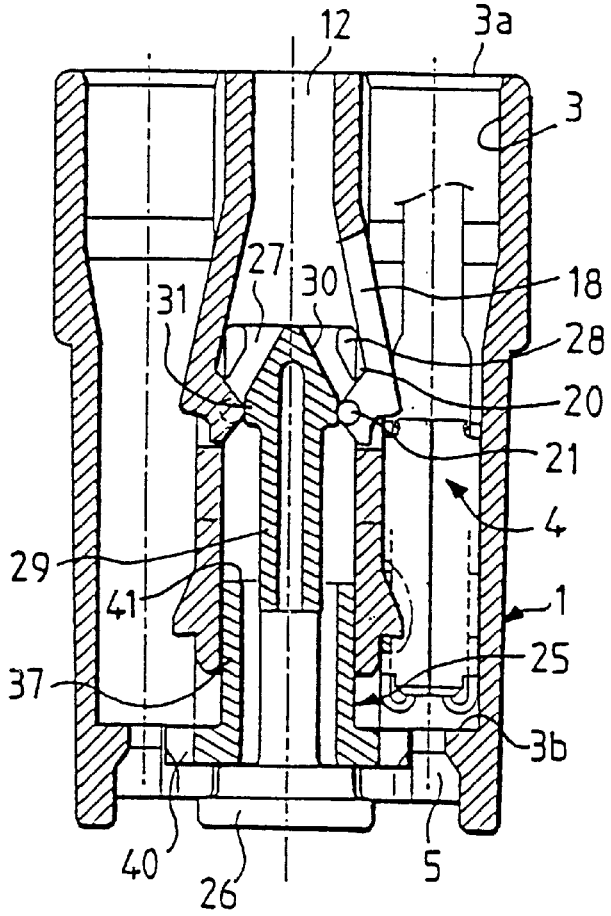
FIG. 4 is a view in section similar to FIG. 2 showing the locking key in the locked position.

As shown in FIGS. 2 and 4, the studs 16 project into the channels 3.

Two elastic tongues 18 in the passage 12 are spaced away from the channels 3 when unstressed and form projections 20 in the passage 12 with lateral studs 21, slots 19 facing said tongues 18 opening into the channels 3. Said tongues can pass through these slots.

Unlike the studs 16, the tongues 18 do not project into the channels 3, but are spaced away from them.

A locking key 25 is inserted in the passage 12 and has a holding end 26, a tubular element 37, two parallel side walls 27 having at their free end ramps 28 and a central pillar 29 terminating in a pointed protuberance 30 having two inclined planes extended by flats 31. The free end of the tubular element 37 forms the abutments 41 opposing locking of the key 25 if the electrical contact members 4 are not correctly in place.

The passage 12 has bosses 35 adapted to cooperate with complementary bosses 36 on the key 25 to lock it in the locking position.

A boss 38 can also be provided in the passage 12 to cooperate with a detent 39 on the key 25 to hold the key in a pre-locking position.

The walls 27 are attached to the end of the key having the holding member 26 to form openings enabling the lugs 15 to move freely in the pre-locking position.

On the other hand, the key 25 does not act on the tongues 18 in the pre-locking position.

Near the openings 5, the element 1 has slots 40 through which a tool can be passed to spread apart the locking lugs 15 in order to remove the members 4 when the key has been withdrawn.

Figure 3:
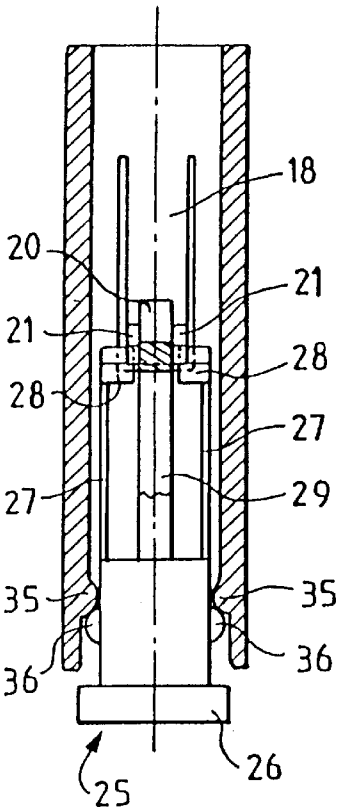
FIG. 3 is a view in section taken along the line 3—3 in FIG. 2.
Figure 1:
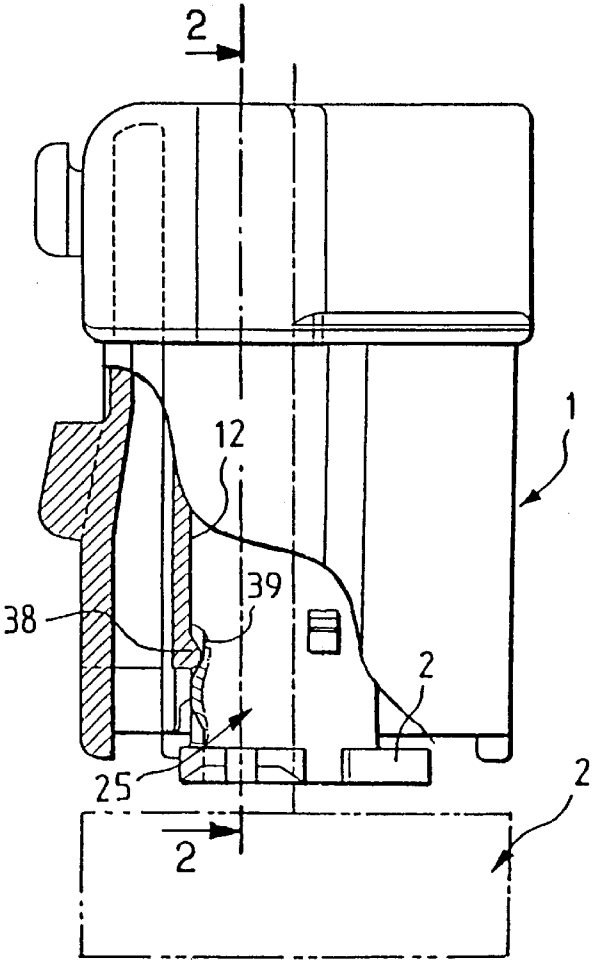
FIG. 1 is an elevation view partly in section of a connector housing element in accordance with the invention.

When the key 25 is in the pre-locking position (see FIGS. 1, 2 and 3), the lugs 15 can move freely and the members 4 can then be inserted from the ends 3*a* and pushed in until they bear against the abutments 3*b*.

During this insertion the members 4 abut against the ramps 16*a* on the studs 16 and tilt the lugs 15 resiliently. When the members 4 are in place, the studs 16 engage in the corresponding openings 10 and immobilize said members 4.

If a member 4 is not inserted properly it projects into the passage 12 and is inserted between the walls 27. Bearing against the abutment 41, it opposes the engagement corresponding to the locking position of the key 25.

Note that in the pre-locking position the key 25 projects at the corresponding end of the element 1 and therefore opposes fitting of the complementary element 2.

When the members 4 have been properly locked into position, the key 25 can be pushed towards the locking position.

During this maneuver the tubular element 37 immobilizes the lugs 15 by cooperating with the face thereof facing towards the passage 12. At the same time the inclined planes of the central pillar 29 the projections 20 push through the slots 19 so that the free ends of the tongues 18 locate behind the shoulders 11.

Note that the studs 21 engage in the space between the inclined planes and the ramps 28. Accordingly, when the key is returned to the pre-locking position, the ramps 28 cooperate with the studs 21 and oblige the tongues 18 to return to their initial position in which they are retracted from the channels 3. The material from which the housing element 1 is made can lose its elasticity with time in which case the tongues 18 might not return to their initial position when the key is returned to the pre-locking position.

In the locked position of the key 25, which is maintained by the bosses 35 and 36, the projections 20 cooperate with the flats 31 which are long enough to compensate any manufacturing differences and therefore to assure that the tongues immobilize the members 4 perfectly in all cases.

Of course, the invention is not limited to the embodiment described and shown. Many modifications of detail can be made thereto without departing from the scope of the invention.

There is claimed:

1. An electrical connector housing element comprising an insulative material body having at least two parallel channels each adapted to receive an electrical contact member with a front end adapted to cooperate with a complementary electrical contact member of a complementary housing element and a rear end adapted to be fixed to an end of an electrical conductor, elastic locking lugs provided in said channels and having studs projecting into said channels and adapted to cooperate with openings of said electrical contact members when said studs are in place in said channels, and a locking key inserted in a passage parallel to and between said channels, said key being adapted to occupy a pre-locking position to enable insertion of said electrical contact members in said channels so that said locking lugs can retract elastically for positioning said electrical contact members and a locking position in which said key cooperates with a face of said locking lugs opposite that provided with said studs, wherein said housing element has elastic tongues projecting into said passage and said locking key is provided with a protuberance adapted, in said locking position, to push said tongues through corresponding slots in said channels so that said tongues project into said channels adjacent a shoulder of each said electrical contact member.

2. The electrical connector housing element claimed in claim 1 wherein said elastic tongues have projections near their free end and facing towards said passage and said protuberance on said locking key is a pointed portion having two inclined planes adapted to cooperate with said projections.

3. The electrical connector housing element claimed in claim 1 wherein said locking key has two walls with free ends having ramps adapted to cooperate with studs provided on said projections on said tongues.

4. The electrical connector housing element claimed in claim 2 wherein said inclined planes of said key are extended by flats.

* * * * *